US007473520B2

(12) United States Patent
Ishikura et al.

(10) Patent No.: US 7,473,520 B2
(45) Date of Patent: Jan. 6, 2009

(54) PHOTOSENSITIVE RESIN COMPOSITION, INK JET RECORDING HEAD USING SUCH COMPOSITION AND METHOD FOR MANUFACTURING SUCH RECORDING HEAD

(75) Inventors: Hiroe Ishikura, Kawasaki (JP); Shoji Shiba, Kawasaki (JP); Akihiko Okano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 500 days.

(21) Appl. No.: 11/291,956

(22) Filed: Dec. 2, 2005

(65) Prior Publication Data

US 2006/0117564 A1 Jun. 8, 2006

(30) Foreign Application Priority Data

Dec. 3, 2004 (JP) ..... 2004-351347

(51) Int. Cl.
*B41J 2/16* (2006.01)

(52) U.S. Cl. ..... 430/320

(58) Field of Classification Search ..... None
See application file for complete search history.

(56) References Cited

U.S. PATENT DOCUMENTS

| | | | | |
|---|---|---|---|---|
| 4,565,859 | A | 1/1986 | Murai et al. | 528/365 |
| 4,657,631 | A | 4/1987 | Noguchi | 156/655 |
| 5,331,344 | A | 7/1994 | Miyagawa et al. | 347/63 |
| 6,461,798 | B1 * | 10/2002 | Ohkuma et al. | 430/320 |
| 7,063,933 | B2 | 6/2006 | Shiba et al. | 430/270.1 |
| 2007/0031756 | A1 | 2/2007 | Shiba et al. | 347/65 |

FOREIGN PATENT DOCUMENTS

| | | |
|---|---|---|
| JP | 60-161973 | 8/1985 |
| JP | 63-221121 | 9/1988 |
| JP | 64-009216 | 1/1989 |
| JP | 02-140219 | 5/1990 |
| JP | 05-124199 | 5/1993 |

* cited by examiner

*Primary Examiner*—John A. McPherson
(74) *Attorney, Agent, or Firm*—Fitzpatrick, Cella, Harper & Scinto

(57) ABSTRACT

The present invention provides a method for manufacturing a high quality ink jet head in which, in a case where a coating resin layer constituting ink flow path walls is formed, even when a solvent having a strong dissolving force is used, it is not feared that a configuration of an ink flow path pattern is distorted. In the method, a photosensitive resin composition layer in which an inter-molecule bridging reaction proceeds by irradiation of an ionization radiant ray having a first wavelength band and a molecule decaying reaction of main chain decomposing type of the resin proceeds by irradiation of an ionization radiant ray having a second wavelength band different from the first wavelength band is formed on a substrate on which energy generating elements were provided. Thereafter, an ink flow path pattern is formed by the irradiation of the ionization radiant ray having the first wavelength band and a developing process. Then, a coating resin layer constituting ink flow path walls is formed on the ink flow path pattern. After ink discharge ports are formed, the photosensitive resin composition layer forming the ink flow path pattern is dissolved and removed by irradiating the ionization radiant ray having the second wavelength band.

12 Claims, 2 Drawing Sheets

PHOTOSENSITIVE RESIN COMPOSITION, INK JET RECORDING HEAD USING SUCH COMPOSITION AND METHOD FOR MANUFACTURING SUCH RECORDING HEAD

BACKGROUND OF THE INVENTION

1. Field of the Invention

The present invention relates to a new photosensitive resin composition, an ink jet head for discharging recording small liquid droplet used in an ink jet recording system and a method for manufacturing such an ink jet head.

More particularly, the present invention relates to an ink jet head manufacturing method in which a photosensitive resin layer contributing to formation of an ink flow path pattern is provided on a substrate for an ink jet head, and an ink jet recording head manufactured by such a manufacturing method.

2. Related Background Art

In general, an ink jet recording head (referred to merely as "head" hereinafter) for performing the recording by discharging ink comprises discharge ports for discharging the ink and ink flow paths which communicate with the respective ink discharge ports and within which pressure generating elements for generating pressure for discharging the ink are provided. Further, it is known to provide a head in which the pressure generating elements are formed on a substrate and ink flow path walls joined to the substrate to define the ink flow paths are provided. Among the heads, particularly, a head in which the ink discharge ports are disposed above the pressure generating elements is called as an ink jet head of side shooter type.

As a method for manufacturing such a head, U.S. Pat. Nos. 4,657,631; 5,331,344 and 5,458,254 disclose the following manufacturing method. That is to say, in the disclosed method, a soluble resin layer is provided on portions for defining ink flow paths and, in a condition that such a soluble resin layer is provided, the resin layer is coated by a coating resin layer which constitutes ink flow path walls later and then the soluble resin layer is removed.

In this manufacturing method, adhesive and the like are not dropped into the ink flow paths and a configuration of the ink flow paths can be formed with high accuracy. As the soluble resin layer, resist of positive type is used from the view point of easy removal. The resist of positive type serves to form a pattern on the basis of a difference in a dissolving speed between an exposed portion and a non-exposed portion, and, in any cases, the soluble resin layer corresponding to ink flow paths is dissolved and removed after exposure.

By the way, regarding such methods, the fact that formation of the coating resin layer provided on the ink flow path pattern and defining the ink flow path walls is performed by using a so-called solvent coat method is described. The solvent coat method is a method in which predetermined resin to be coated is dissolved in solvent and the resulting solvent is coated. As a representative solvent coat method, there is a spin coat method. Since the spin coat method has an advantage that a film thickness can easily be controlled uniformly, this method is frequently used in the method for manufacturing the head of side shooter type.

In a case where the coating resin layer constituting the ink flow path walls later is formed by the solvent coat method, since the resist of positive type is used as the soluble resin layer for the ink flow path pattern, the solvent must be selected carefully. That is to say, if a dissolving force of the solvent used in the solvent coat method is too strong, a non-exposed portion of the soluble resist of positive type may be partially dissolved by the solvent, with the result that the configuration of the obtained flow path pattern may be distorted.

By the way, in order to obtain a uniform film thickness of the film formed on the ink jet head substrate by the solvent coat method represented by the spin coat method, a vaporizing speed of the solvent and viscosity of the solvent must be adjusted. Particularly, in the ink jet head field, since such a film is normally formed to have a thickness considerably greater than a film thickness in a semiconductor field, it is difficult to make the film thickness uniform unless various film forming conditions are controlled more strictly in comparison with the films in the semiconductor field. Further, since the film thickness of the ink flow path pattern affects an influence upon an ink discharging property, the adjustment of the vaporizing speed and the viscosity affects a great influence upon through-put of the ink jet head. In particular, regarding the vaporizing speed of the solvent, the uniform film thickness can be achieved more easily in the solvent having slower vaporizing speed than in the solvent having higher vaporizing speed. However, in general, many of solvents having the slower vaporizing speed have a strong dissolving force which may distort the configuration of the ink flow path pattern, thereby causing a through-put problem. Thus, the solvent having the slower vaporizing speed does not necessarily contribute to the enhancement of productivity.

SUMMARY OF THE INVENTION

The present invention is made in consideration of the above problems, and an object of the present invention is to provide a method for manufacturing a high quality ink jet head and an ink jet head manufactured by such a method, in which, in formation of a coating resin layer constituting an ink flow path walls later, even when a solvent having a strong dissolving force is used, a configuration of an ink flow path pattern is not distorted. Another object of the present invention is to provide a new photosensitive resin composition suitably used for achieving the above object.

In order to achieve the above object, the present invention provides a photosensitive resin composition including a resin having structure units shown by the following general formula (1) and a cationic photopolymerization initiator and in which a bridging reaction between molecules (referred to as "inter-molecular bridging reaction" hereinafter) of the resin proceeds by irradiation of an ionization radiant ray having a first wavelength band and a molecule decaying reaction of main chain decomposing type of the resin proceeds by irradiation of an ionization radiant ray having a second wavelength band different from the first wavelength band:

general formula 1

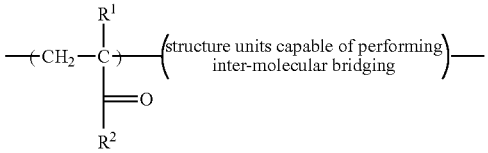

(where, $R^1$ is hydrogen atom, alkyl group or halogen atom; $R^2$ shows $R^{21}$ or $R^{21}O$ ($R^{21}$ is alkyl group, substituted or non-substituted aromatic ring group, or substituted or non-substituted heterocyclic group))

According to another embodiment of the present invention, there is provided a photosensitive resin composition including a resin having structure units shown by the following general formula (2), a cationic photopolymerization initiator and a bridging agent and in which an inter-molecule bridging reaction, via the bridging agent, of the resin proceeds by irradiation of an ionization radiant ray having a first wavelength band and a molecule decaying reaction of main chain decomposing type of the resin proceeds by irradiation of an ionization radiant ray having a second wavelength band different from the first wavelength band:

general formula 2

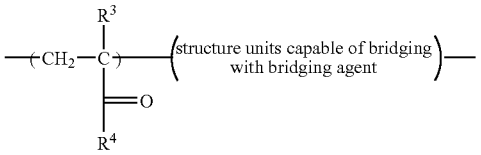

(where, $R^3$ is hydrogen atom, alkyl group or halogen atom; $R^4$ shows $R^{41}$ or $R^{41}O$ ($R^{41}$ is alkyl group, substituted or non-substituted aromatic ring group, or substituted or non-substituted heterocyclic group))

Further, the present invention provides a method for manufacturing an ink jet head including an ink discharge port for discharging ink, an ink flow path communicated with the ink discharge port and an energy generating element for generating energy for discharging the ink, the method comprising the steps of (1) providing the energy generating element on a substrate, (2) forming a photosensitive resin composition layer on the substrate on which the energy generating element was provided to coat the energy generating element, wherein, in the photosensitive resin composition layer, an inter-molecule bridging reaction proceeds by irradiation of an ionization radiant ray having a first wavelength band and a molecule decaying reaction proceeds by irradiation of an ionization radiant ray having a second wavelength band different from the first wavelength band, (3) irradiating the ionization radiant ray having the first wavelength band on a predetermined portion of the photosensitive resin composition layer, (4) forming an ink flow path pattern by removing a portion of the photosensitive resin composition layer which is not irradiated by the ionization radiant ray having the first wavelength band, by means of a developing process, (5) forming a coating resin layer constituting an ink flow path wall later on the substrate on which the ink flow path pattern was formed, (6) forming the ink discharge port in a portion of the coating resin layer which is disposed above the energy generating element, (7) irradiating the ionization radiant ray having the second wavelength band onto the photosensitive resin composition layer forming the ink flow path pattern and (8) forming the ink flow path communicated with the ink discharge port, by dissolving and removing the portion of the photosensitive resin composition layer which was irradiated by the ionization radiant ray having the second wavelength band. Further, the present invention also provides an ink jet head manufactured by such a method.

According to the ink jet head manufacturing method of the present invention, there is provided a high quality ink jet head in which, in the formation of the coating resin layer constituting the ink flow path wall later, even when a solvent having a strong dissolving force is used, the ink flow path pattern is not distorted.

DESCRIPTION OF THE PREFERRED EMBODIMENTS

Figure 1:
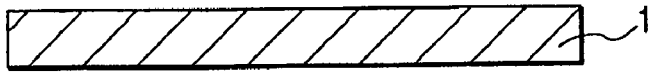
FIG. 1 is a sectional view of a substrate.

Now, the present invention will be fully explained. First of all, a photosensitive resin composition will be described.

In the photosensitive resin composition of the present invention, an inter-molecule bridging reaction proceeds by irradiation of an ionization radiant ray having a first wavelength band and a molecule decaying reaction proceeds by irradiation of an ionization radiant ray having a second wavelength band different from the first wavelength band. In the present invention, by using such a photosensitive resin composition, a photosensitive resin composition layer is formed on a substrate on which energy generating elements were provided. The photosensitive resin composition layer permits the patterning, since only an irradiated portion of the layer can be formed as a non-dissolved area by the bridging reaction achieved by the irradiation of the ionization radiant ray having the first wavelength band. Further, after the patterning, since the photosensitive resin composition layer is molecule-decayed to be changed to low molecular compound by the irradiation of the ionization radiant ray having the second wavelength band different from the first wavelength band, the layer can be dissolved and removed.

That is to say, in the manufacture of the ink jet head, by forming a portion corresponding to an ink flow path by using the photosensitive resin composition, an ink flow path pattern can be formed by the irradiation of the ionization radiant ray having the first wavelength band. Further, thereafter, through the irradiation of the ionization radiant ray having the second wavelength band different from the first wavelength band, the ink flow path pattern can be decomposed, with the result that a last washing process can be performed very easily for a short time. Thus, since the configuration of the ink flow path pattern is not distorted and the resin constituting the ink flow path pattern can be dissolved and removed easily, the present invention has a great advantage particularly in a case where more minute orifices are formed.

As the photosensitive resin compositions in which the inter-molecular bridging reaction proceeds by the irradiation of the ionization radiant ray having the first wavelength band and the molecule decaying reaction proceeds by the irradiation of the ionization radiant ray having the second wavelength band different from the first wavelength band, the following photosensitive resin compounds can be listed up:

A photosensitive resin composition including a resin having structure units shown by the following general formula (1) and a cationic photopolymerization initiator:

general formula 1

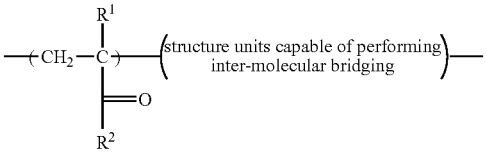

in the above formula, $R^1$ is hydrogen atom, alkyl group or halogen atom; and $R^2$ shows $R^{21}$ or $R^{21}O$ ($R^{21}$ is alkyl group, substituted or non-substituted aromatic ring group, or substituted or non-substituted heterocyclic group).

A photosensitive resin composition including a resin having structure units shown by the following general formula (2), a cationic photopolymerization initiator and a bridging agent:

general formula 2

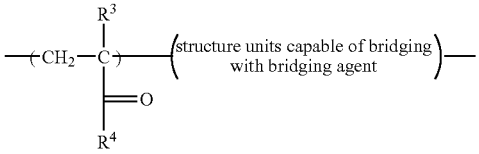

in the above formula, $R^3$ is hydrogen atom, alkyl group or halogen atom; and $R^4$ shows $R^{41}$ or $R^{41}O$($R^{41}$ is alkyl group, substituted or non-substituted aromatic ring group, or substituted or non-substituted heterocyclic group).

In the general formula (1), the carbon number of the alkyl group which can be selected in $R^1$ is preferably 1 or 2. Further, the carbon number of the alkyl group which can be selected in $R^{21}$ is preferably 1 to 4. As $R^1$ in the general formula (1), methyl group or ethyl group is preferable. Further, as $R^2$, methoxy group, ethoxy group or phenyl group is preferable. $R^1$ and $R^2$ may have a straight chain structure, a brunched chain structure or a ring structure. $R^1$ and $R^2$ can be selected independently per a unit.

The structure unit capable of performing the inter-molecule bridging in the general formula (1) is preferably a structure unit of polyvinyl ketone system or polyacryl system having a substituent capable of performing the inter-molecule bridging. The substituent capable of performing the inter-molecule bridging is more preferably a substituent capable of performing cationic polymerization. As such substituents capable of performing the inter-molecule bridging, epoxy group and vinyl group can be listed up.

When the total unit number is 100 units, a ratio of the structure units capable of performing the inter-molecule bridging included in the resin having the structure units shown in the general formula (1) is preferably 5 to 50 units and more preferably 10 to 30 units. The reason is that, if the number of the structure units capable of performing the inter-molecule bridging is too small, since the inter-molecular bridging reaction becomes hard to proceed, it may become difficult to form the ink flow path pattern; whereas, if the number of the structure units capable of performing the inter-molecule bridging is too great, even when the molecule decaying reaction proceeds, the resin may be insoluble with respect to developing liquid.

The resin having the structure units shown in the general formula (1) may have other structure units, within a range in which the molecule decaying reaction can be performed by the irradiation of the ionization radiant ray having the second wavelength band.

As concrete examples of the resins having the structure units shown in the general formula (1), although the following copolymers can be listed up, the present invention is not limited to these copolymers:

compound 1

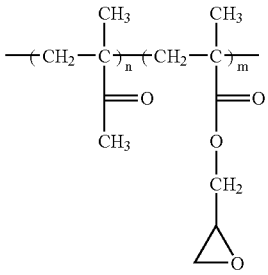

compound 2

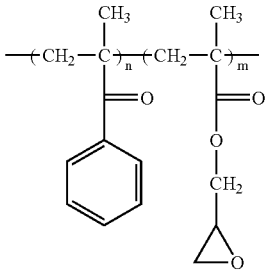

compound 3

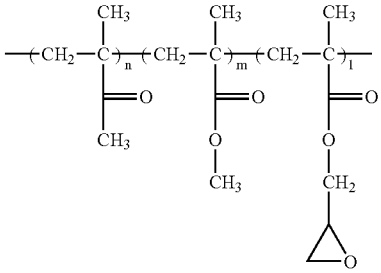

compound 4

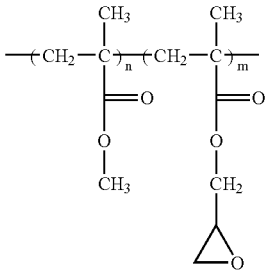

compound 5

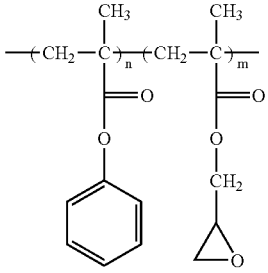

In the above chemical formulae, l, m and n are independent positive integral numbers. Incidentally, in the above chemical formulae, an arrangement order of respective units is at the option (this is similar to chemical formulae representing copolymers, hereinafter).

A weight average molecular weight of the resin having the structure units shown in the general formula (1) is preferably 10000 to 200000. The reason is that, if the molecular weight is too small, the resin is changed to liquid and thus, it may be difficult to form the film and to perform the subsequent light illumination reaction process; whereas, if the molecular weight is too great, viscosity is increased to make difficult to form a uniform coating film and to deteriorate sensitivity of the optical decaying reaction.

In the formula (2), the carbon number of the alkyl group which can be selected in $R^3$ is preferably 1 or 2. Further, the carbon number of the alkyl group which can be selected in $R^{41}$ is preferably 1 to 4. As $R^3$ in the general formula (2), methyl group or ethyl group is preferable. Further, as $R^4$, methoxy group, ethoxy group or phenyl group is preferable. $R^3$ and $R^4$ may have a straight chain structure, a brunched chain structure or a ring structure. $R^3$ and $R^4$ can be selected independently per a unit.

The structure unit capable of bridging with the bridging agent in the general formula (2) is preferably a structure unit of polyvinyl ketone system or polyacryl system having a substituent capable of bridging with the bridging agent. The substituent capable of bridging with the bridging agent is more preferably a substituent including active hydrogen. As such substituents capable of bridging with the bridging agent, hydroxy group and cyclic imide group can be listed up.

When the total unit number is 100 units, a ratio of the structure units capable of bridging with the bridging agent included in the resin having the structure units shown in the general formula (2) is preferably 5 to 50 units and more preferably 10 to 30 units. The reason is that, if the number of the structure units capable of bridging with the bridging agent is too small, since the inter-molecular bridging reaction becomes hard to proceed, it may become difficult to form the ink flow path pattern; whereas, if the number of the structure units capable of bridging with the bridging agent is too great, even when the molecule decaying reaction proceeds, the resin may be insoluble with respect to developing liquid. The resin having the structure units shown in the general formula (2) may have other structure units, within a range in which the molecule decaying reaction can be performed by the irradiation of the ionization radiant ray having the second wavelength band.

As concrete examples of the resins having the structure units shown in the general formula (2), although the following copolymers can be listed up, the present invention is not limited to these copolymers:

compound 6

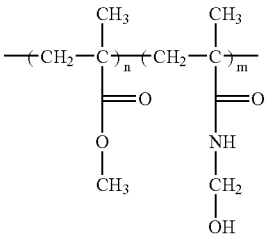

-continued compound 7

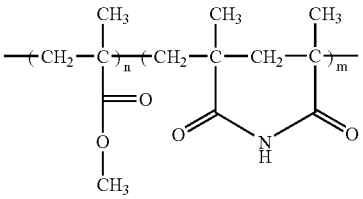

In the above chemical formulae, m and n are independent positive integral numbers.

A weight average molecular weight of the resin having the structure units shown in the general formula (2) is preferably 10000 to 200000. The reason is that, if the molecular weight is too small, the resin is changed to liquid and thus, it may be difficult to form the film and to perform the subsequent light illumination reaction process; whereas, if the molecular weight is too great, viscosity is increased to make difficult to form a uniform coating film and to deteriorate sensitivity of the optical decaying reaction.

As bridging agents used with the resin having the structure units shown in the general formula (2), any bridging agent capable of performing the inter-molecular bridging of the structure units having shown in the general formula (2) via said bridging agent may be used, and, for example, a bridging agent capable of bridging with a substituent including active hydrogen under an acidic condition can be used. As a bridging agent for the resin having the structure units shown in the general formula (2), there is a bridging agent of melamine system as shown in the following general formula (3):

general formula 3

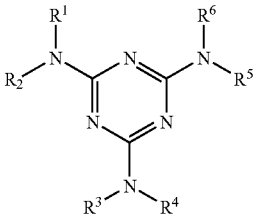

In the above formula, $R^1$ to $R^6$ indicate hydrogen atom or methyrol group or alkoxy methyl group to which alkoxy group having the carbon number of 1 to 4 is coupled, and these may be the same as or different from each other.

A used amount of the bridging agent is preferably 5 to 30 mass parts, with respect to 100 mass parts of the resin having the structure units shown in the general formula (2).

Further, as a cationic photopolymerization initiator, aromatic phosphonium salt, aromatic iodonium salt, aromatic sulfonium salt or imide sulfonium compound may be used. Particularly, in a photosensitive resin composition system including the resin having the structure units shown in the general formula. (2), the aromatic sulfonium salt is preferably used.

A used amount of the cationic photopolymerization initiator is preferably 0.1 to 20 mass parts and more preferably 0.5 to 4 mass parts, with respect to total 100 mass parts of components other than cationic photopolymerization initiator included in the photosensitive resin composition.

Incidentally, in the illustrated embodiment, as a resin included in the photosensitive resin composition constituting the photosensitive resin composition layer, as exemplified above, preferably, a compound of polyvinyl ketone system or a compound of a polyacrylic system is used. Since the compounds of polyvinyl ketone system and polyacrylic system compound generally have high yield of the decomposing reaction for the ionization radiant ray, the photosensitive resin compound layer can be dissolved and removed quickly.

In the above-mentioned photosensitive resin composition, by absorption of the cationic photopolymerization initiator, when subjected to the irradiation of the ionization radiant ray, the inter-molecule bridging reaction proceeds. On the other hand, in the molecule decaying reaction, the reaction proceeds by the ionization radiant ray having a wavelength band of 200 to 280 nm (second wavelength band). Regarding this wavelength band, the first wavelength band for proceeding the inter-molecule bridging reaction may be a longer wavelength band or the second wavelength band may be a longer wavelength band; but, from the view point that the molecule decaying reaction proceeds efficiently, a photosensitive resin composition in which the first wavelength band becomes the longer wavelength band than the second wavelength band is preferably used. Incidentally, although the first wavelength band for proceeding the inter-molecule bridging reaction is preferably separated from the second wavelength band for proceeding the molecule decaying reaction completely, these wavelength bands may be overlapped partially. In this case, non-overlapped wavelength bands can be used as the first wavelength band and the second wavelength band, respectively to carry out the present invention.

According to the present invention, in the formation of the ink flow path pattern, since the resin constituting the ink flow path pattern is made insoluble by the optical bridging reaction, even when the coating resin layer constituting the ink flow path walls later is formed by using the solvent having the strong dissolving force, it is not feared that the configuration of the ink flow path pattern is distorted. Accordingly, the ink flow path pattern having the uniform thickness can easily be achieved, thereby providing an ink jet head having a high accurate ink flow paths. Further, the limitation of the solvent for forming the coating resin layer constituting the ink flow path walls later is substantially eliminated, with the result that materials for forming the coating resin layer which was not used heretofore can be used and, thus, a range of selection of the materials and solvents for forming the coating resin layer is widened.

Now, the present invention will be described in further detail with reference to the accompanying drawings. Incidentally, FIGS. 1 to 8 are schematic sectional views showing sections of the ink jet head during the head is being manufactured by the manufacturing method of the present invention.

First of all, in the present invention, a substrate 1 made of, for example, glass, ceramic, plastic or metal is used (FIG. 1). Such a substrate 1 can be used without particular limitation of configuration and material thereof, so long as the substrate functions as a part of a liquid flow path constituting member and also functions as a support for material layers for forming the ink flow paths and the ink discharge ports which will be described later.

Figure 2:
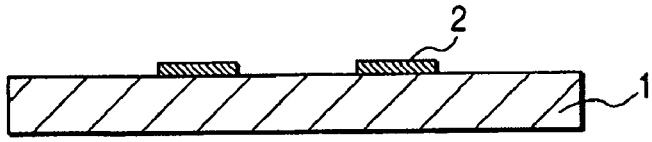
FIG. 2 is a sectional view of the substrate on which energy generating elements were formed.

Then, a desired number of energy generating elements 2 such as electrothermal converting elements or piezoelectric elements are installed on the substrate 1 (FIG. 2). By the energy generating elements 2, discharge energy for discharging recording liquid droplets is applied to ink liquid, thereby performing the recording. For example, when the electrothermal converting element is used as the energy generating element 2, the element 2 applies heat to the surrounding recording liquid, with the result that a condition of the recording liquid is changed to generate the discharge energy. Further, for example, when the piezoelectric element is used, the discharge energy is generated by mechanical vibration of the element. As the energy generating element, the electrothermal converting element is preferable.

Incidentally, electrodes (not shown) for control signals operating the elements are connected to these energy generating elements 2. Further, various function layers such as a protective layer (not shown) may be provided in order to enhance endurance of the energy generating elements 2.

Figure 3:
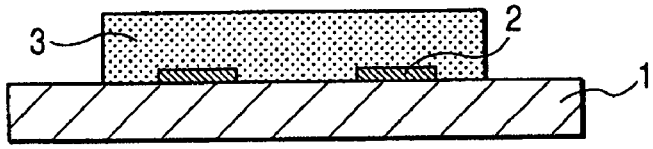
FIG. 3 is a sectional view of the substrate in which an ink flow path pattern was formed on the substrate of FIG. 2.

Then, as shown in FIG. 3, an ink flow path pattern 3 is formed on the substrate 1 on which the energy generating elements 2 were formed.

In order to form the ink flow path pattern, in the present invention, a photosensitive resin composition layer in which an inter-molecule bridging reaction proceeds by irradiation of an ionization radiant ray having a first wavelength band and a molecule decaying reaction proceeds by irradiation of an ionization radiant ray having a second wavelength band different from the first wavelength band is formed. Thereafter, the ionization radiant ray having the first wavelength band is irradiated onto a predetermined portion of the photosensitive resin composition layer. Then, a portion of the photosensitive resin composition layer which is not irradiated by the ionization radiant ray having the first wavelength band is removed by a developing process, thereby forming the ink flow path pattern.

The photosensitive resin composition for forming the photosensitive resin composition layer used in the present invention permits the patterning by the bridging reaction performed by the irradiation of the ionization radiant ray having the first wavelength band via a mask. After the patterning, in the photosensitive resin composition layer, the molecule decaying reaction proceeds by the irradiation of the ionization radiant ray having the second wavelength band different from the wavelength band of the ionization radiant ray used in the bridging reaction, with the result that, since this photosensitive resin composition layer is changed into a low molecule compound which can be dissolved and removed, the last washing process can be performed very easily for a short time. Further, in the formation of the ink flow path pattern, since the resin corresponding to the ink flow path pattern was made insoluble by the optical bridging reaction, even when a coating resin layer constituting ink flow path walls later is formed by using a solvent having a strong dissolving force, it is not feared that the configuration of the ink flow path pattern is distorted. Accordingly, the ink flow path pattern having the uniform thickness can easily be achieved.

Figure 4:
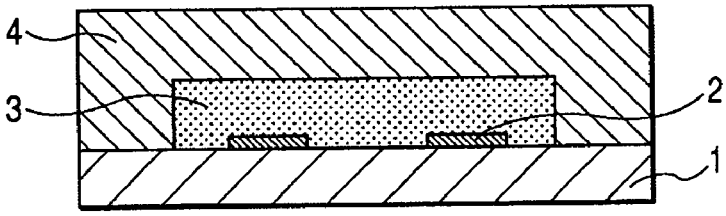
FIG. 4 is a sectional view of the substrate in which a coating resin layer was formed on the substrate of FIG. 3.

As shown in FIG. 4, a coating resin layer 4 constituting ink flow path walls later is formed on the substrate 1 on which the ink flow path pattern 3 was formed in this way, by a normal spin coat method, roll coat method or slit coat method.

The coating resin layer 4 is preferably photosensitive, since ink discharge ports 6 which will be described later can be easily formed in this layer with high accuracy by photolithography. Regarding resin composition for forming such a coating resin layer, high mechanical strength as structural material, a closely contacting ability with an underlying layer, durability against the ink and a resolving power for patterning a minute pattern for the ink discharge ports are requested. As a material satisfying such properties, for example, epoxy resin composition of cationic polymerization type can preferably be used.

As the epoxy resin composition, the following substances can be listed up; but, the present invention is not limited to such substances. More specifically, such composition may be a reactant having a molecular weight greater than about 900 among reactants between bisphenol A and epichlorohydrin, a reactant between bromo-containing bisphenol A and epichlorohydrin, a reactant between phenol novolac or o-cresol novolac and epichlorohydrin or the like. Further, as disclosed in Japanese Patent Application Laid-open Nos. S60-161973 (1985), S63-221121 (1988), S64-9216 (1989) and H02-140219 (1990), the epoxy resin composition may include an epoxy compound such as a multifunctional epoxy resin having oxy cyclohexane frame.

Further, regarding the above-mentioned epoxy compound, a compound in which epoxy equivalent is preferably smaller than 2000 and more preferably smaller than 1000 is preferably used. The reason is that, if the epoxy equivalent exceeds 2000, bridging density is decreased during the curing reaction, which may cause problems regarding the closely contacting ability and the durability against the ink.

Further, since the epoxy compound permits the cationic polymerization, the cationic photopolymerization initiator may be used. In this case, by the photolithography, the ink discharge ports 6 can easily be formed with high accuracy while realizing the high mechanical strength, the closely contacting ability with the underlying layer, the durability against the ink and the resolving power for patterning the minute pattern for the ink discharge ports.

As the cationic photopolymerization initiators, aromatic iodonium salt, aromatic sulfonium salt, SP-170 and SP-172 (trade names) sold by ASAHI DENKA KOGYO Co. Ltd and WPAG-455 (trade name) sold by WAKOH JUN-YAKU KOGYO can be listed up.

Further, the above-mentioned cationic photopolymerization initiators can promote the cationic polymerization (the bridging density is increased in comparison with sole cationic photopolymerization) by heating them with the aid of a reducing agent. However, when the cationic photopolymerization initiator is used together with the reducing agent, the reducing agent should be selected so that an initiator system of so-called redox type, in which the reaction does not occur under a room temperature but occurs at a temperature greater than a predetermined temperature (preferably, more than 60° C.), is obtained. As such a reducing agent, copper compound, particularly copper triflate (trifluoro methane copper sulfonate (II) is optimal in consideration of a reaction ability and a dissolving ability to the epoxy resin. Further, if necessary, an additive can appropriately be added to the resin composition. For example, a flexibility adding agent may be added in order to decrease elastic modulus of the resin or a silica coupling agent may be added in order to obtain a stronger adhering force to the underlying substrate.

Such a resin composition is dissolved in a proper solvent and the coating resin layer 4 is formed by the normal spin coat method, roll coat method or slit coat method as mentioned above. Although the solvent used in the coating solution is not particularly limited, the solvent having the strong dissolving force which could not used substantially in the prior art can also be used. For example, ziglime, methyl ethyl ketone or the like can be used.

Figure 5:
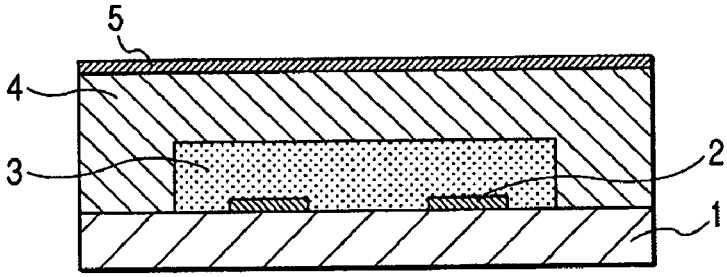
FIG. 5 is a sectional view of the substrate in which an ink-repellent agent layer was formed on the substrate of FIG. 4.

Then, if necessary, a photosensitive ink-repellent agent layer 5 can be formed on the coating resin layer 4 (FIG. 5). Although the ink-repellent agent layer 5 can be formed by a coating method such as a spin coat method, a roll coat method or a slit coat method, since this layer is formed on the uncured coating resin layer 4, it is necessary that both layers do not have excessive compatibility.

Further, as mentioned above, in the case where the cationic photopolymerization composition is used as the coating resin layer 4, it is preferable that a compound having functional group capable of performing the cationic polymerization is also included in the photosensitive ink-repellent agent layer 5. However, the ink-repellent agent layer 5 does not necessarily include the cationic photopolymerization initiator, but, the ink-repellent agent layer may be reacted and cured by using the cationic photopolymerization initiator included in the coating resin layer 4.

Then, ink discharge ports 6 (FIG. 6) are formed in portions of the coating resin layer 4 (coating resin layer 4 and the ink-repellent agent layer 5 if the ink-repellent agent layer 5 is provided) disposed above the energy generating elements 2. When the coating resin layer 4 (coating resin layer 4 and the ink-repellent agent layer 5 if the ink-repellent agent layer 5 is provided) is/are photosensitive, pattern exposure is performed via a mask (not shown) and the ink discharge ports 6 can be formed by the developing process using an appropriate solvent.

Figure 7:
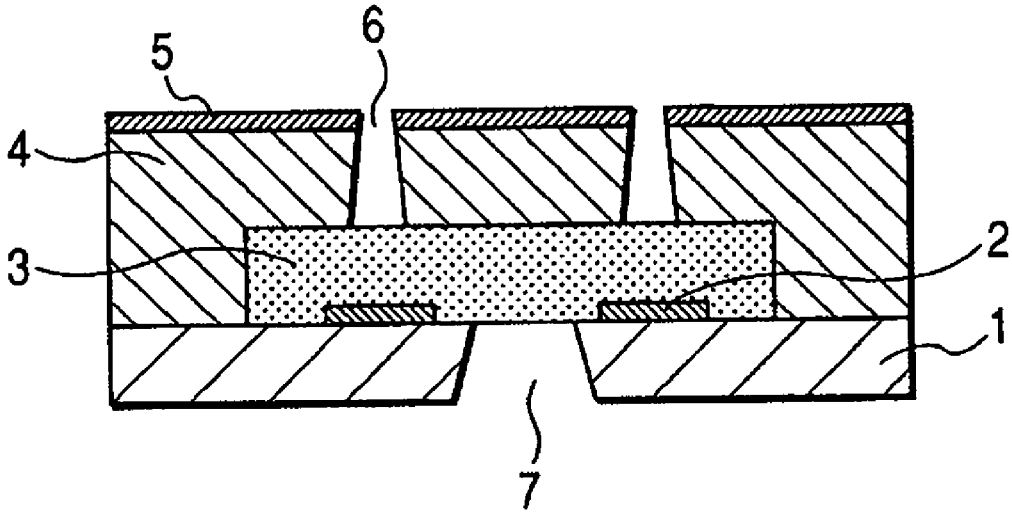
FIG. 7 is a sectional view of the substrate in which an ink supply port was formed in the substrate of FIG. 6.

Then, an ink supply port 7 is formed (FIG. 7). As a method for forming the ink supply port 7, a method using an excimer laser, a drill or sand blast method or an etching method can appropriately used.

Figure 8:
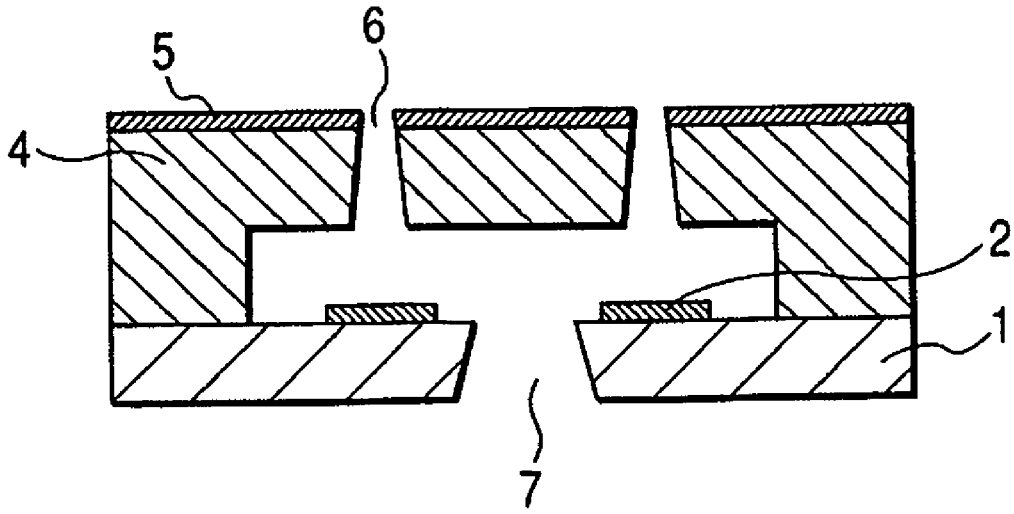
FIG. 8 is a sectional view of a completed ink jet head.

Then, by irradiating the ionization radiant ray having the second wave length band onto the ink flow path pattern 3 formed on the substrate 1, the photosensitive resin composition constituting the ink flow path pattern 3 can be dissolved and removed. If necessary, by a heating process, the coating resin layer 4 and the ink-repellent agent layer 5 can also be cured completely. Further, joining of members (not shown) for the ink supply and electrical joining or connecting for driving the energy generating elements 2 can be carried out to complete the ink jet head (FIG. 8).

EMBODIMENTS

First Embodiment (Manufacturing of Ink Jet Head)

In this embodiment, in accordance with the procedures shown in FIGS. 1 to 8, an ink jet head was manufactured and was evaluated.

First of all, electrothermal converting elements (heaters comprised of material $HfB_2$) as the energy generating elements 2, and a silicon substrate 1 having an (SiN+Ta) laminated layer (not shown) at portions corresponding to the ink flow paths and nozzles to be formed were prepared (FIG. 2).

Then, a photosensitive resin composition layer was formed on the substrate 1 and a flow path pattern 3 was formed by the following technique (FIG. 3). Incidentally, as the photosensitive resin composition, a photosensitive resin composition obtained by adding a cationic photopolymerization initiator (manufactured by ASAHI DENKA KOGYO company; trade name: SP-170) to copolymer of methyl isopropenyl ketone and glycyzil methacrylate (compound 8; copolymer unit ratio 90:10) was used.

compound 8

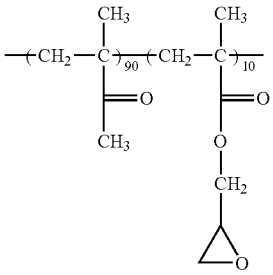

weight average molecular weight (Mw: polystyrene conversion)=30000 dispersion degree (Mw/Mn)=2.5

Resin powder of the compound 8 was dissolved into cyclohexane with solid content density of about 30 wt % and this was used as resist liquid. In this case, the cationic photopolymerization initiator of 2 wt % was added to the resin. After the resist liquid was coated by the spin coat method and was pre-baked at 100° C. for 3 minutes, it was exposed with an exposure amount of 1000 mJ/m$^2$ by using UV light having a wavelength of 300 to 370 nm. Thereafter, by performing the developing process by using methyl isobutyl ketone as the developing liquid, the ink flow path pattern 3 having a thickness of 10 μm was formed.

Then, a photosensitive resin composition for forming the coating resin layer having the following composition was coated on the substrate on which the ink flow path pattern 3 was formed, by the spin coat method (dried film thickness from the surface of the substrate 1 is 20 μm). Then, it is baked at 100° C. (hot plate) for 2 minutes, thereby forming the coating resin layer 4 (FIG. 4).

The above composition is as follows:

| | |
|---|---|
| EHPE (trade name; manufactured by DAISERU KAGAKU KOGYO) | 100 mass parts |
| 1,4 HFAB (trade name; manufactured by CENTRAL GARASU) | 20 mass parts |
| SP-170 (trade name; manufactured by ASAHI DENKA KOGYO) | 2 mass parts |
| A-187 (trade name; manufactured by NOHON YUNIKA) | 5 mass parts |
| Methyl isobutyl ketone | 100 mass parts |
| Ziglime | 100 mass parts |

Subsequently, a photosensitive resin composition for forming the ink-repellent agent layer having the following composition was coated on the substrate on which the coating resin layer 4 was formed, by the spin coat method, to have a dried film thickness of 1 μm. Then, it is baked at 80° C. (hot plate) for 3 minutes, thereby forming the ink-repellent agent layer 5 (FIG. 5).

The above composition is as follows:

| | |
|---|---|
| EHPE-3158 (trade name; manufactured by DAISERU KAGAKU KOGYO) | 35 mass parts |
| 2,2-bis(4-glycyzil oxy phenyl)hexafluoropropane | 25 mass parts |
| 1,4-bis(2-hydroxy hexafluoroisopropyl)benzene | 25 mass parts |
| 3-(2-perfluorohexyl)ethoxy-1,2-epoxy propane | 16 mass parts |
| A-187 (trade name; manufactured by NOHON YUNIKA) | 4 mass parts |
| SP-170 (trade name; manufactured by ASAHI DENKA KOGYO) | 2 mass parts |

Diethylene glycol monoethylether 100 mass parts

Figure 6:
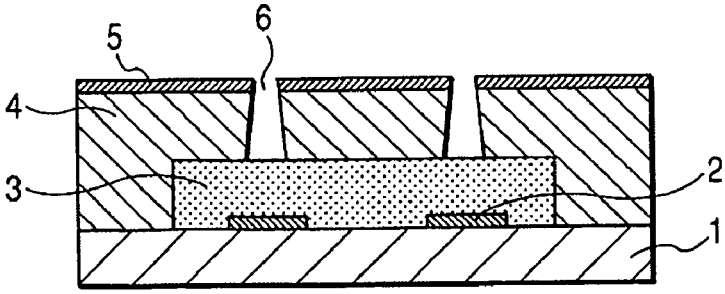
FIG. 6 is a sectional view of the substrate in which ink discharge ports were formed in the substrate of FIG. 5.

Then, the patterning of the coating resin layer 4 and the ink-repellent agent layer 5 was performed to form the ink discharge ports 6 (FIG. 6). Incidentally, in this embodiment, an ink discharge port pattern including the ink discharge ports having a diameter of 15 μm was formed. More specifically, the pattern exposure is performed via a mask (not shown) and the developing process is carried out to form the ink discharge ports 6. That is to say, by developing the coating resin layer 4 and the ink-repellent agent layer 5 as the pattern-exposed nozzle constituting members by using an appropriate solvent, as shown in FIG. 6, the ink discharge ports 6 can be formed.

Then, an etching mask was formed on the back surface of the substrate 1 by using positive type resist (trade name: OFPR-800; manufactured by TOKYO OUKA KOGYO) and an ink supply port 7 (FIG. 7) was formed by performing anisotropy etching of the silicon substrate in accordance with the known technique disclosed in Japanese Patent Application Laid-open No. H05-124199 (1993). Incidentally, in this case, a protective film (trade name: OBC; manufactured by TOKYO OUKA KOGYO) was coated on the ink-repellent agent layer 5 in order to protect the ink-repellent agent layer 5 from etching liquid.

Then, after the protective film on the ink-repellent agent layer 5 was dissolved and removed by using xylene, whole-surface exposure was performed through the coating resin layer 4 and the ink-repellent agent layer 5 with an exposure amount of 80000 mJ/cm$^2$, thereby making the resin composition of the ink flow path pattern 3 soluble. Subsequently, the assembly was dipped in methyl lactate while applying ultrasonic wave thereto to dissolve and remove the ink flow path pattern 3, thereby manufacturing the ink jet head (FIG. 8).

(Evaluation of Ink Jet Head)

In order to ascertain the quality of the ink jet head manufactured in this way, first of all, the configuration of the ink flow path pattern was observed by a microscope. Incidentally, in this embodiment, since the coating resin layer 4 and the ink-repellent agent layer 5 are transparent, the configuration of the ink flow paths can be observed through the coating resin layer 4 and the ink-repellent agent layer 5. As a result, it was found that the configuration of the ink flow paths was not distorted. Further, the ink jet head was mounted to a recording apparatus and the printing was performed by using ink comprised of pure water/glycerol/direct black 154 (water-soluble black dye) having a ratio of 65/30/5. As a result, it was found that stable printing could be achieved.

Second Embodiment

An ink jet head was manufactured in the similar manner to the first embodiment, except that the compound 8 included in the photosensitive resin composition was changed to copolymer of phenyl isopropenyl ketone and glycyzil methacrylate (compound 9; copolymerization unit ratio=85:15).

compound 9

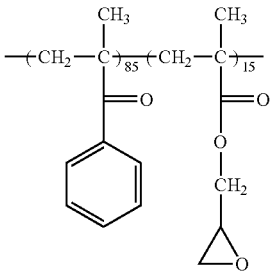

weight average molecular weight (Mw: polystyrene conversion)=32000 dispersion degree (Mw/Mn)=1.8

Similar to the first embodiment, the configuration of the ink flow paths was observed by a microscope. As a result, it was found that the configuration of the ink flow paths was not distorted. Further, as a result that the printing was performed in the similar manner as the first embodiment, it was found that stable printing could be achieved.

Third Embodiment

An ink jet head was manufactured in the similar manner to the first embodiment, except that the compound 8 included in the photosensitive resin composition was changed to copolymer of methyl isopropenyl ketone and methyl methacrylate and glycyzil methacrylate (compound 10; copolymerization unit ratio=70:15:15).

compound 10

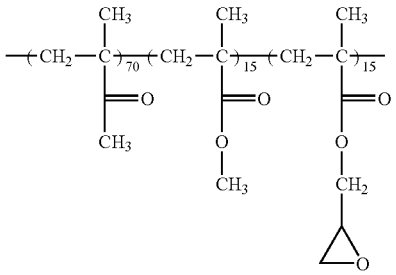

weight average molecular weight (Mw: polystyrene conversion)=28000 dispersion degree (Mw/Mn)=2.0

Similar to the first embodiment, the configuration of the ink flow paths was observed by a microscope. As a result, it was found that the configuration of the ink flow paths was not distorted. Further, as a result that the printing was performed in the similar manner as the first embodiment, it was found that stable printing could be achieved.

Fourth Embodiment

An ink jet head was manufactured in the similar manner to the first embodiment, except that the compound 8 included in the photosensitive resin composition was changed to copolymer of methyl methacrylate and glycyzil methacrylate (compound 11; copolymerization unit ratio=90:10).

compound 11

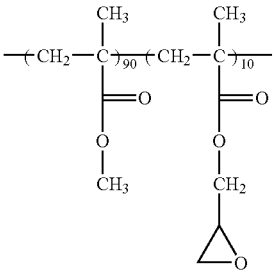

weight average molecular weight (Mw: polystyrene conversion)=25000 dispersion degree (Mw/Mn)=2.1

Similar to the first embodiment, the configuration of the ink flow paths was observed by a microscope. As a result, it was found that the configuration of the ink flow paths was not distorted. Further, as a result that the printing was performed in the similar manner as the first embodiment, it was found that stable printing could be achieved.

Fifth Embodiment

An ink jet head was manufactured in the similar manner to the first embodiment, except that the compound 8 included in the photosensitive resin composition was changed to copolymer of phenyl methacrylate and glycyzil methacrylate (compound 12; copolymerization unit ratio=80:20).

compound 12

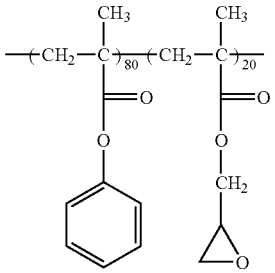

weight average molecular weight (Mw: polystyrene conversion)=25000 dispersion degree (Mw/Mn)=2.1

Similar to the first embodiment, the configuration of the ink flow paths was observed by a microscope. As a result, it was found that the configuration of the ink flow paths was not distorted. Further, as a result that the printing was performed in the similar manner as the first embodiment, it was found that stable printing could be achieved.

Sixth Embodiment

The compound 8 included in the photosensitive resin composition was changed to copolymer (compound 13; copolymerization unit ratio=80:20) of methyl methacrylate and acryl derivative compound including glutaric group. Further, an ink jet head was manufactured in the similar manner to the first embodiment, except that hexamethoxy methyl melamine (trade name: MW-30HM; manufactured by SANWA CHEMICAL) of 10 wt % was added to the resin as a bridging agent.

compound 13

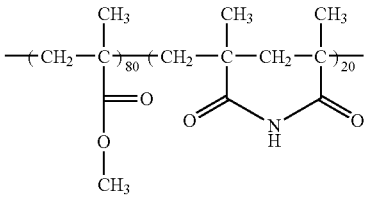

weight average molecular weight (Mw: polystyrene conversion)=37000 dispersion degree (Mw/Mn)=2.7

Similar to the first embodiment, the configuration of the ink flow paths was observed by a microscope. As a result, it was found that the configuration of the ink flow paths was not distorted. Further, as a result that the printing was performed in the similar manner as the first embodiment, it was found that stable printing could be achieved.

Seventh Embodiment

The compound 8 included in the photosensitive resin composition was changed to copolymer (compound 14; copolymerization unit ratio=85:15) of methyl methacrylate and hydroxy methyl methacryl amide. Further, an ink jet head was manufactured in the similar manner to the first embodiment, except that hexamethoxy methyl melamine (trade name: MW-30HM; manufactured by SANWA CHEMICAL) of 10 wt % was added to the resin as a bridging agent.

compound 14

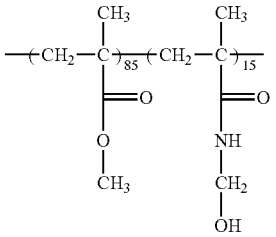

weight average molecular weight (Mw: polystyrene conversion)=35000 dispersion degree (Mw/Mn)=3.0

Similar to the first embodiment, the configuration of the ink flow paths was observed by a microscope. As a result, it was found that the configuration of the ink flow paths was not distorted. Further, as a result that the printing was performed in the similar manner as the first embodiment, it was found that stable printing could be achieved.

This application claims priority from Japanese Patent Application No. 2004-351347 filed on Dec. 3, 2004, which is hereby incorporated by reference herein.

What is claimed is:

1. A method for manufacturing an ink jet head including an ink discharge port for discharging ink, an ink flow path communicated with said ink discharge port and an energy generating element for generating energy for discharging the ink, the method comprising the steps of:

(1) providing said energy generating element on a substrate;

(2) forming a photosensitive resin composition layer on said substrate on which said energy generating element was provided to coat said energy generating element, wherein, in said photosensitive resin composition layer, an inter-molecule bridging reaction proceeds by irradiation of an ionization radiant ray having a first wavelength band and a molecule decaying reaction proceeds by irradiation of an ionization radiant ray having a second wavelength band different from the first wavelength band;

(3) irradiating the ionization radiant ray having the first wavelength band on a predetermined portion of said photosensitive resin composition layer;

(4) forming an ink flow path pattern by removing a portion of said photosensitive resin composition layer which is not irradiated by the ionization radiant ray having the first wavelength band, by means of a developing process;

(5) forming a coating resin layer constituting an ink flow path wall on said substrate on which said ink flow path pattern was formed;

(6) forming said ink discharge port in a portion of said coating resin layer which is disposed above said energy generating element;

(7) irradiating the ionization radiant ray having the second wavelength band onto said photosensitive resin composition layer forming said ink flow path pattern; and (8) forming said ink flow path communicated with said ink discharge port, by dissolving and removing the portion of the photosensitive resin composition layer which was irradiated by the ionization radiant ray having the second wavelength band.

2. An ink jet head manufacturing method according to claim 1, wherein the first wavelength band is a longer wavelength band than the second wavelength band.

3. An ink jet head manufacturing method according to claim 1, wherein the photosensitive resin composition for forming said photosensitive resin composition layer includes resin having a structure unit shown by the following general formula (1):

general formula 1

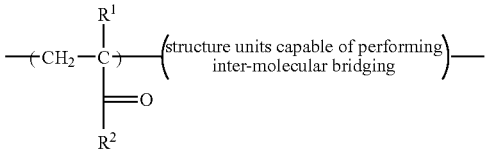

where, $R^1$ is hydrogen atom, alkyl group or halogen atom and $R^2$ shows $R^{21}$ or $R^{21}O$ ($R^{21}$ is alkyl group, substituted or non-substituted aromatic ring group, or substituted or non-substituted heterocyclic group).

4. An ink jet head manufacturing method according to claim 3, wherein the structure unit capable of performing the inter-molecule bridging in said general formula (1) includes a substituent capable of performing cationic polymerization.

5. An ink jet head manufacturing method according to claim 4, wherein the photosensitive resin composition includes a cationic photopolymerization initiator.

6. An ink jet head manufacturing method according to claim 5, wherein the cationic photopolymerization initiator is aromatic phosphonium salt.

7. An ink jet head manufacturing method according to claim 1, wherein the photosensitive resin composition for forming said photosensitive resin composition layer includes resin having a structure unit shown by the following general formula (2) and a bridging agent:

general formula 2

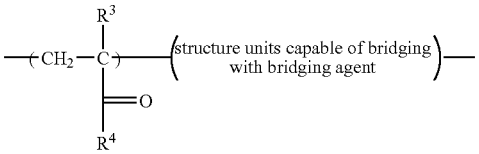

where, $R^3$ is hydrogen atom, alkyl group or halogen atom and $R^4$ shows $R^{41}$ or $R^{41}O$ ($R^{41}$ is alkyl group, substituted or non-substituted aromatic ring group, or substituted or non-substituted heterocyclic group).

8. An ink jet head manufacturing method according to claim 7, wherein the structure unit capable of bridging with the bridging agent includes a substituent having active hydrogen.

9. An ink jet head manufacturing method according to claim 8, wherein the bridging agent is a bridging agent is capable of bridging with the substituent having the active hydrogen under an acidic condition.

10. An ink jet head manufacturing method according to claim 7, wherein the photosensitive resin composition includes a cationic photopolymerization initiator.

11. An ink jet head manufacturing method according to claim 1, wherein the resin composition for forming said coating resin layer includes at least curable epoxy compound.

12. An ink jet head manufacturing method according to claim 1, wherein the resin composition for forming said coating resin layer includes a cationic photopolymerization initiator.

* * * * *